US008162441B2

(12) United States Patent
Lee et al.

(10) Patent No.: US 8,162,441 B2
(45) Date of Patent: Apr. 24, 2012

(54) INK-CARTRIDGE LOADING/UNLOADING APPARATUS

(75) Inventors: Jeong-Guck Lee, Seongnam (KR); Hae-Sung Jung, Seoul (KR); Ki-Yong Kim, Kyeongki-do (KR); Kwang-Choon Chung, Kyeongki-do (KR); Chang-Soo Yu, Kyeongki-do (KR)

(73) Assignee: Inktec Co., Ltd., Kyeongki-do (KR)

( * ) Notice: Subject to any disclaimer, the term of this patent is extended or adjusted under 35 U.S.C. 154(b) by 805 days.

(21) Appl. No.: 12/093,810

(22) PCT Filed: Nov. 15, 2006

(86) PCT No.: PCT/KR2006/004794

§ 371 (c)(1),
(2), (4) Date: Sep. 9, 2008

(87) PCT Pub. No.: WO2007/058460

PCT Pub. Date: May 24, 2007

(65) Prior Publication Data

US 2011/0174950 A1 Jul. 21, 2011

(30) Foreign Application Priority Data

Nov. 15, 2005 (KR) ..... 10-2005-0109331

(51) Int. Cl.
*B41J 2/14* (2006.01)

(52) U.S. Cl. ..... 347/49

(58) Field of Classification Search ..... 347/37, 347/49, 50

See application file for complete search history.

(56) References Cited

U.S. PATENT DOCUMENTS

| | | | | |
|---|---|---|---|---|
| 4,907,018 | A * | 3/1990 | Pinkerpell et al. | 346/139 R |
| 5,646,665 | A * | 7/1997 | Swanson et al. | 347/87 |
| 6,170,940 | B1 * | 1/2001 | Shinada et al. | 347/86 |
| 6,634,738 | B1 * | 10/2003 | Shinada et al. | 347/86 |
| 6,736,486 | B2 * | 5/2004 | Nakamura et al. | 347/49 |
| 2002/0135634 | A1 | 9/2002 | Lodal et al. | |

FOREIGN PATENT DOCUMENTS

| | | |
|---|---|---|
| EP | 1219448 A2 | 7/2002 |
| EP | 1348562 A2 | 10/2003 |
| JP | 7052377 | 2/1995 |
| JP | 07052377 | 2/1995 |
| JP | 08108546 | 4/1996 |
| JP | 8108546 | 4/1996 |
| KR | 20040070964 | 8/2004 |

* cited by examiner

*Primary Examiner* — Anh Thi Ngoc Vo
(74) *Attorney, Agent, or Firm* — The Webb Law Firm

(57) ABSTRACT

The present invention relates to an ink-cartridge loading/unloading apparatus used in various devices onto which an ink-cartridge is capable of minimizing damage of a flexible printed wiring board of the ink-cartridge. The ink-cartridge loading/unloading apparatus according to the present invention comprises a vertically extending main body having a support portion; a mounting part connected to the front surface of the main body; and a coupling part connecting the main body and the mounting part. A metal coupling bar or a magnetic substance inserted in a coupling bar is attached to an electromagnet provided in a side of the main body, whereby the mounting part is coupled to the main body. The mounting part is released from a coupled state by pressing a button bar with an external force, and an elastic means is further provided between the mounting part and the main body.

12 Claims, 7 Drawing Sheets

【Figure 1】
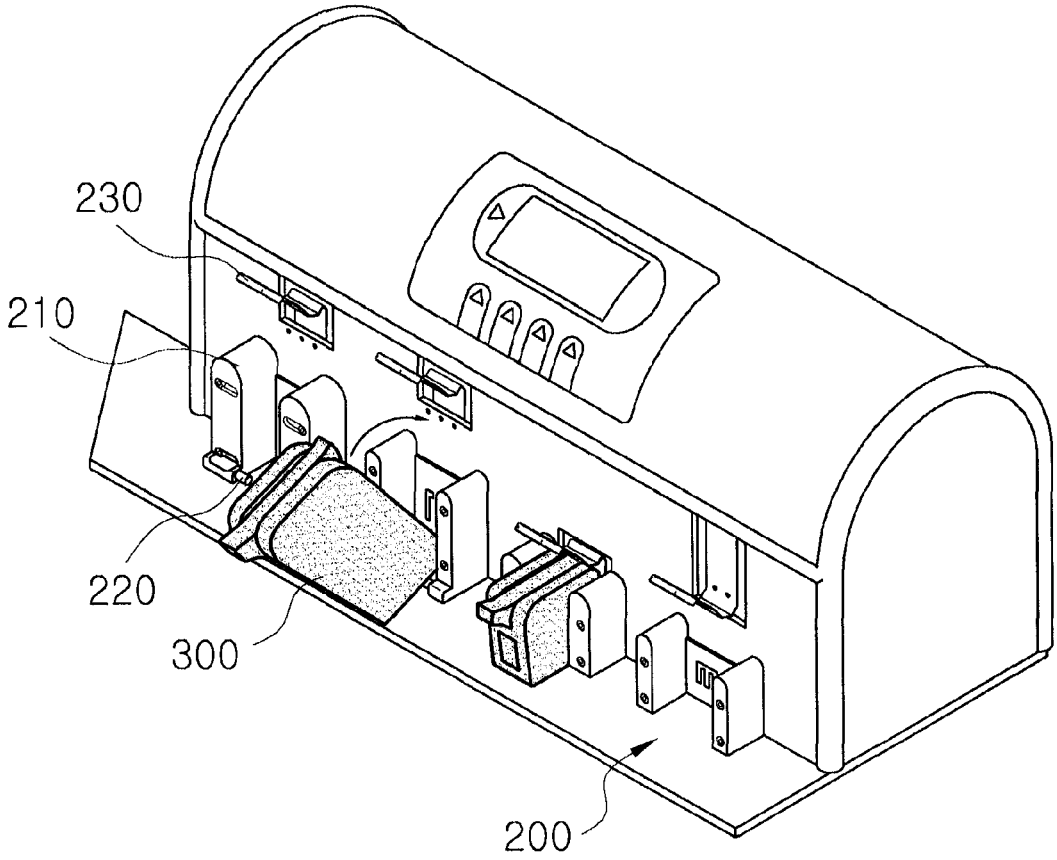

【Figure 2】
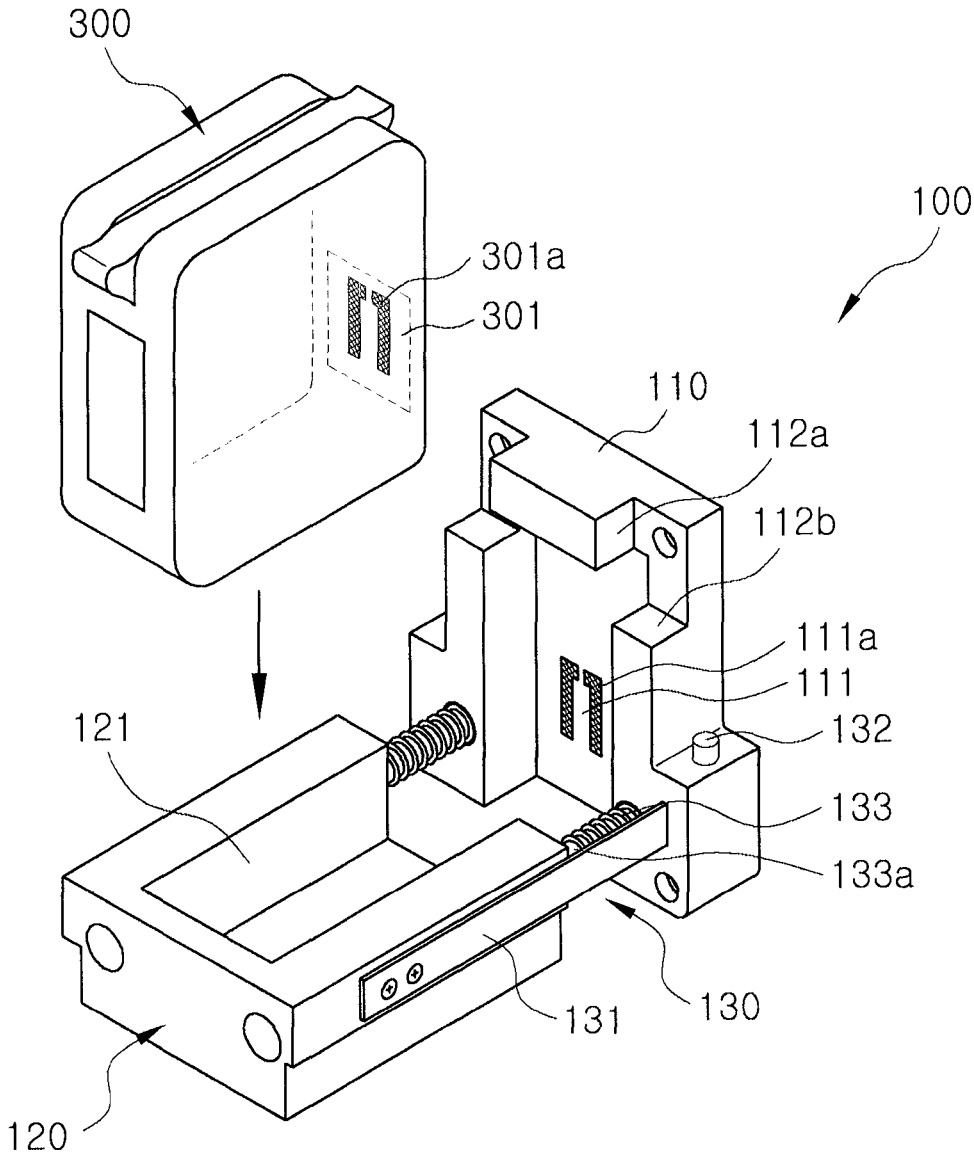

【Figure 3】
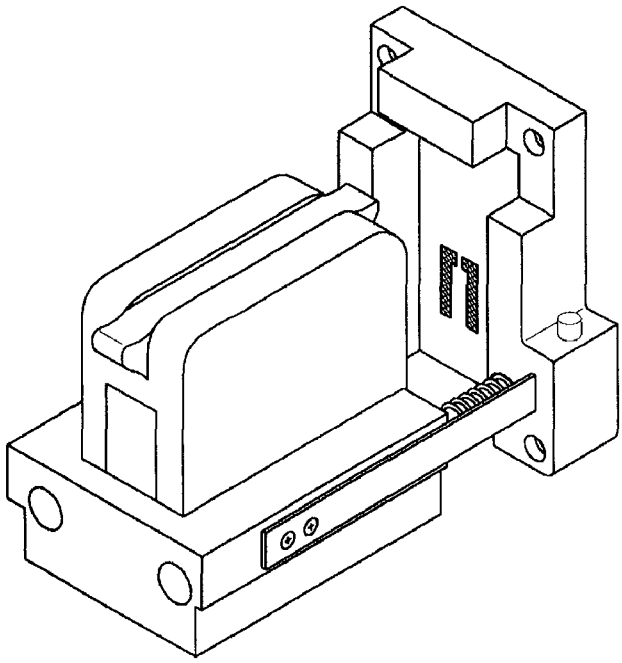
(A)
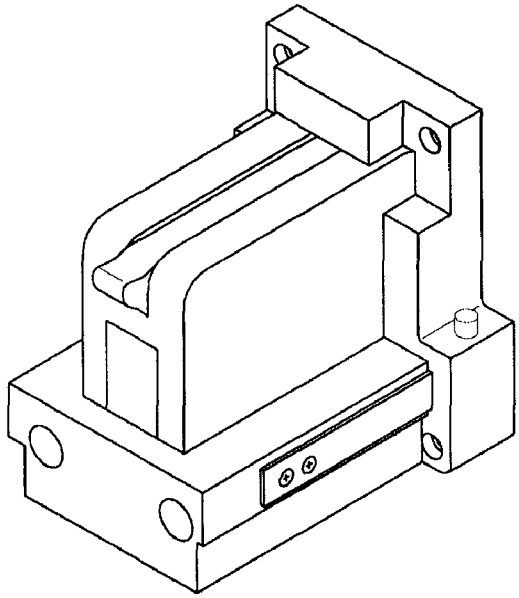
(B)

【Figure 4】
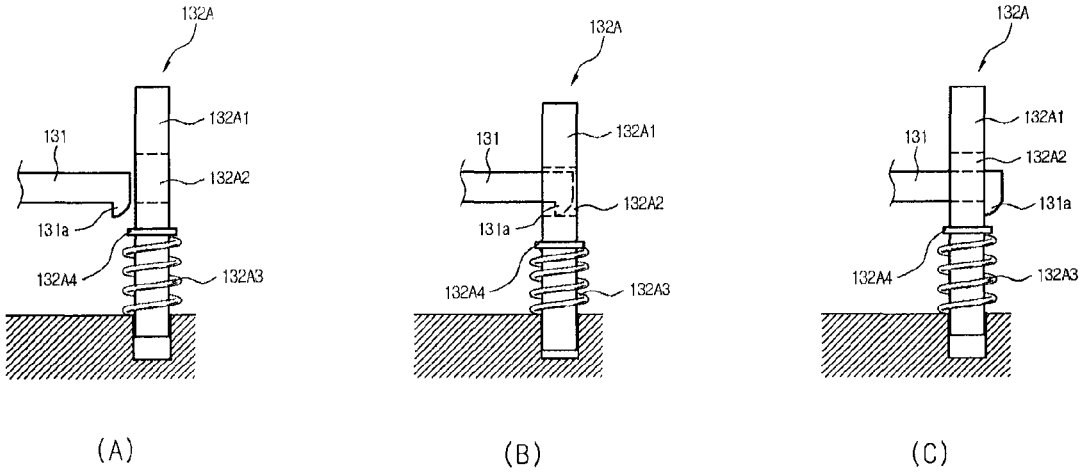
【Figure 5】
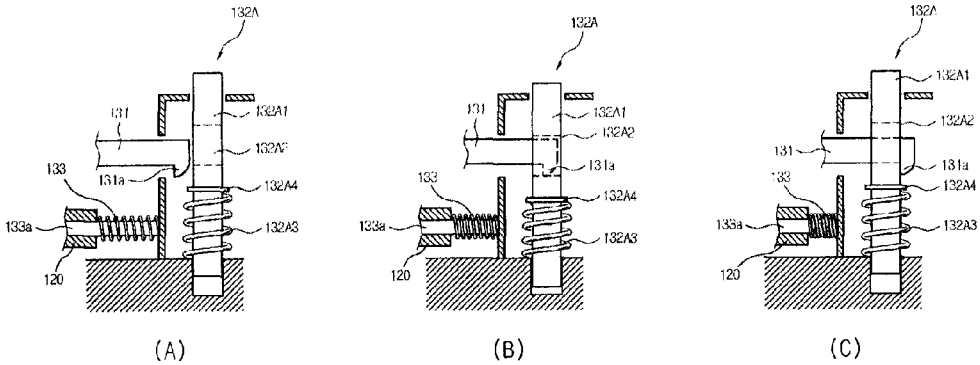
【Figure 6】
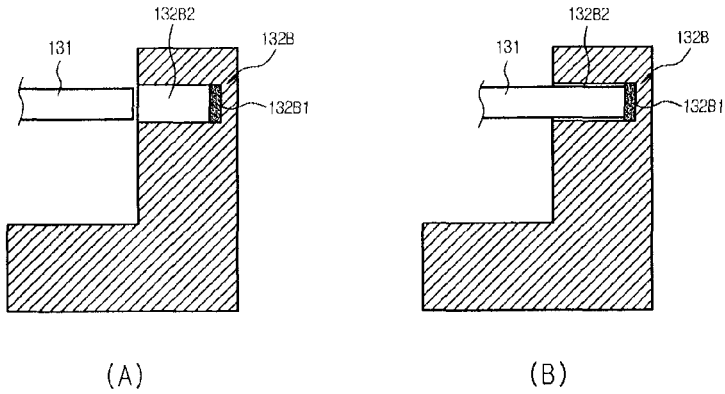

【Figure 7】
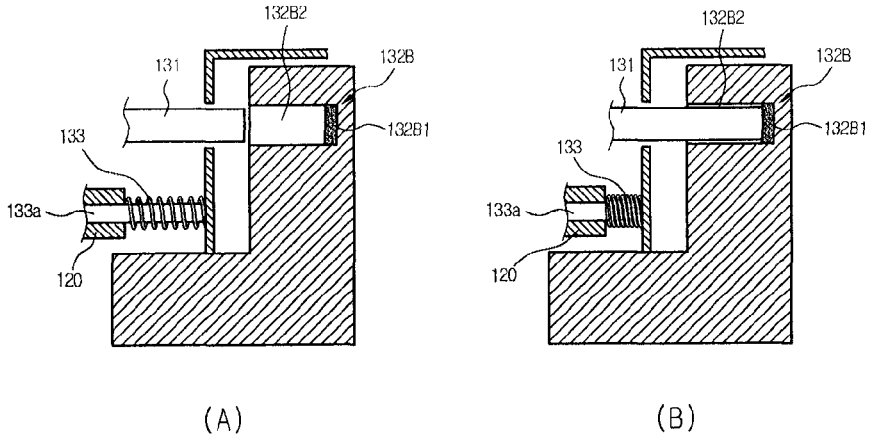
【Figure 8】
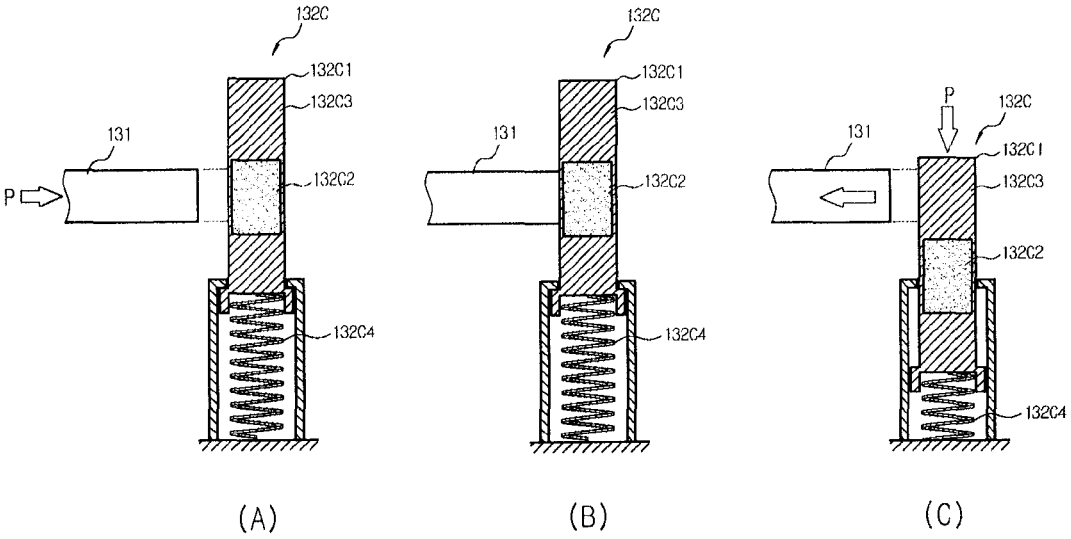

【Figure 9】
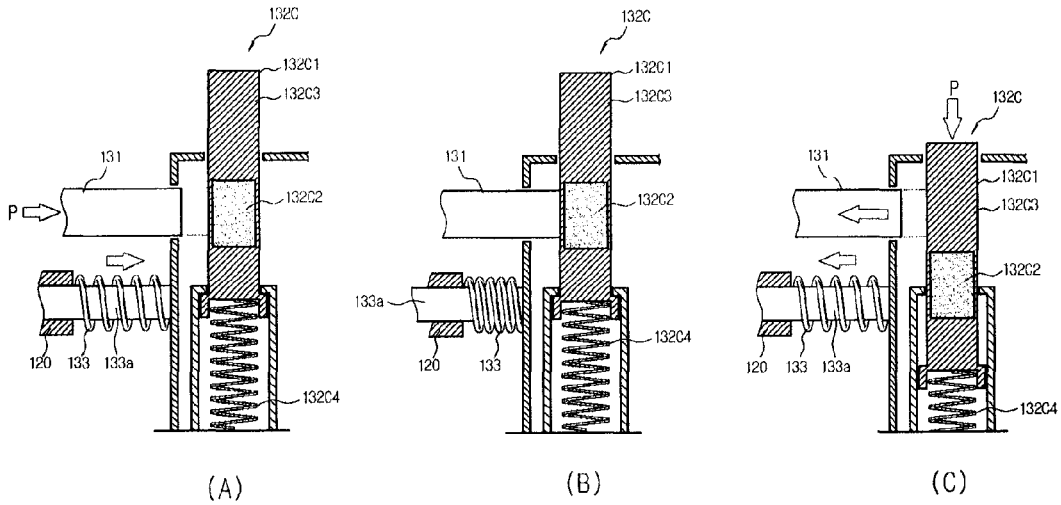
【Figure 10】
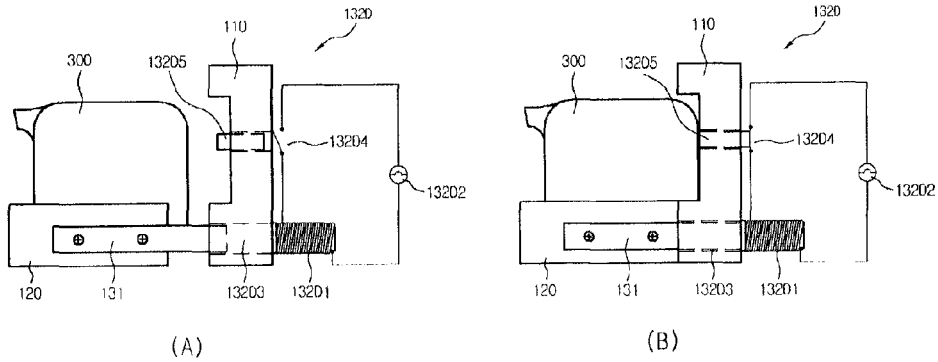
【Figure 11】
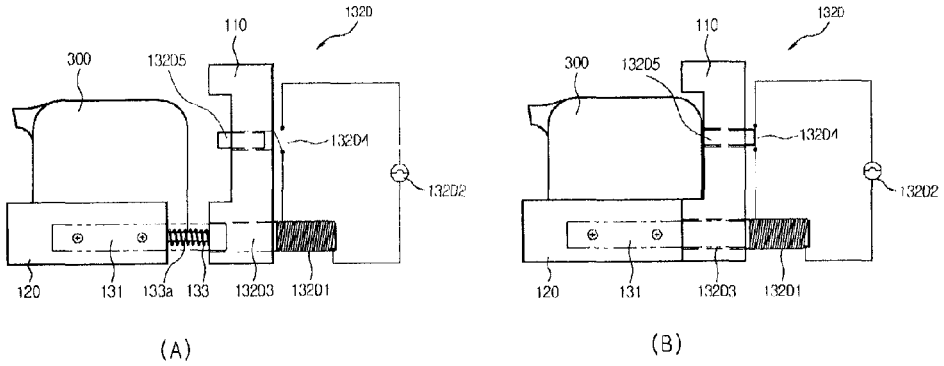

【Figure 12】
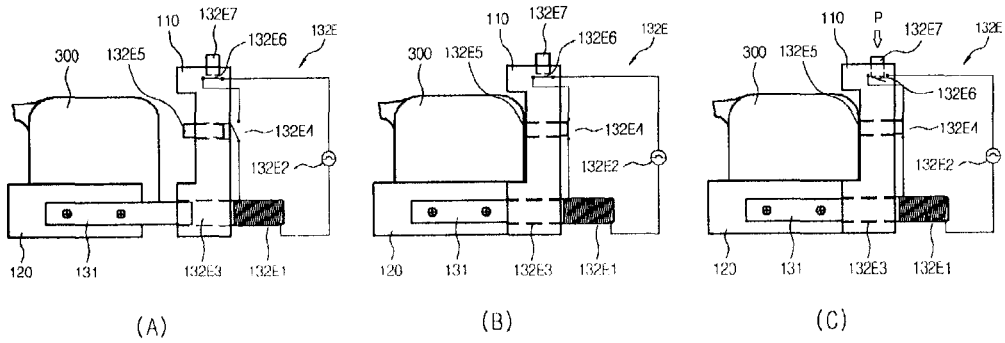
【Figure 13】
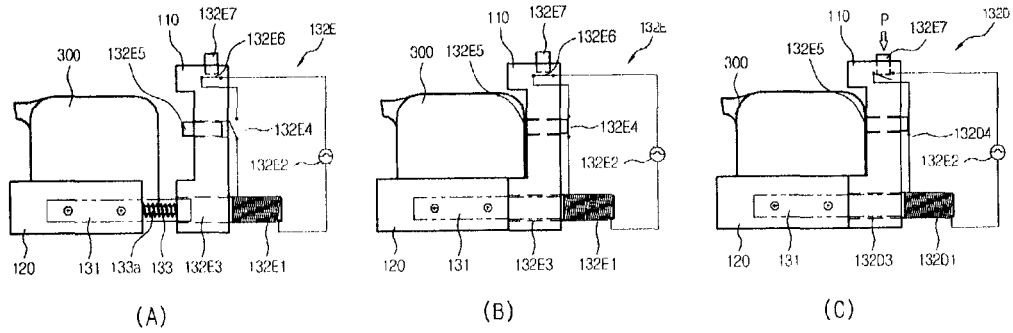

INK-CARTRIDGE LOADING/UNLOADING APPARATUS

TECHNICAL FIELD

The present invention relates to an ink-cartridge loading/unloading apparatus. More particularly, the present invention relates to an ink-cartridge loading/unloading apparatus used in various devices, such as an inkjet printer, an ink-cartridge tester and etc., onto which an ink-cartridge is loaded/unloaded and capable of minimizing damage of a contact portion of a flexible printed wiring board of the ink-cartridge.

BACKGROUND ART

Various types of printing apparatus have developed and manufactured for outputting various kinds of results or works prepared using a computer. Among these, widely used printing apparatus are largely divided into an inkjet printer and a laser beam printer; it is well known that printing shops as well as homes and offices are provided with the inkjet printer because the inkjet printer can be provided in much lower price compared with the laser beam printer for obtaining an output with almost same quality as that of the laser beam printer. Conventionally, the inkjet printer prints characters or images by jetting ink onto a surface of a paper while an ink-cartridge loaded on a carrier within the printer moves horizontally. Describing in more detail, when the ink-cartridge is loaded on the carrier, then the ink contained within the ink-cartridge is supplied to a printer nozzle and jetted onto a paper by an electric signal from a control part of the printer. At this time, printing signal transferring contacts of the printer and contacts of a flexible printed wiring board of the ink-cartridge come into contact with each other to transfer signals, thus an amount of ink jetting is controlled so as to print characters or images.

Meanwhile, as an ink-cartridge, which is once used up, is discarded, very large amount of wastes and extravagance of resources are occurred in this process. In order to solve these problems of an increase of maintaining cost which customers would have to pay, the occurrence of the wastes and the extravagance of resources, a technique for refilling ink to an ink-cartridge of which ink is used up and recycling it has been developed and commercialized. It is possible to recycle the ink-cartridge because it is sufficient for the ink-cartridge to contain ink therein and supply the ink when a proper passage is connected. That is, in the case of an ink-cartridge of which ink is normally used up, because the ink alone is used up while a containing part of the ink-cartridge, a nozzle, contacts of a flexible printed wiring board or etc. are hardly damaged, the ink-cartridge can be used like a new ink-cartridge only by refilling ink to the ink containing part of the ink-cartridge. Damage of nozzle is mostly an obstruction of the nozzle due to remained ink, and such damage is mostly temporary damage that even a common user can easily removes by applying moisture to the nozzle using a damp cloth or etc.

However, if a flexible printed wiring board which receives a printing signal, status signal or etc. for controlling an ink jetting amount is damaged, malfunction that an ink jetting amount can not be correctly controlled or an amount of remained ink may be inaccurately measured is occurred, and thus such ink-cartridge can not be recycled. It is well known that ink-cartridge refillers conventionally have an ink-cartridge tester for testing possibility of use of an ink-cartridge to be refilled so as to prevent exhaustive failure of filling ink to an ink-cartridge, damaged as above mentioned and thus impossible of recycling.

In the various apparatus above mentioned onto which an ink-cartridge is loaded/unloaded such as an ink-cartridge loading/unloading apparatus for a printer, an ink-cartridge loading/unloading apparatus for a tester or etc., a conventional apparatus adopts a method that an ink-cartridge is loaded by pivoting itself by predetermined angle around a lower portion thereof (or of an ink-cartridge mounting member) when loading it. However, the conventional loading/unloading apparatus of pivot type has several problems in use.

Firstly, in the case that an ink-cartridge is loaded onto a tester in pivot manner, it is highly possible that contacts of a flexible printed wiring board of an ink-cartridge and signal transferring contacts of a tester can not come into contact with each other in correct places and are offset and thus come into contact with each other in incorrect places.

Secondly, in addition to above phenomenon, as pressure is distributed not uniformly but in bias by its characteristics, damage such as a scar tends to be generated in contacts of the ink-cartridge and contacts of the tester.

Such problems consequently give permanent damage to contact circuit of an ink-cartridge and thus results in a low recycling rate of ink cartridges.

DISCLOSURE

Technical Problem

Therefore, the present invention seeks to solve these problems associated with prior arts and an object of the present invention is to provide an ink-cartridge loading/unloading apparatus, in which damage of contacts of a flexible printed wiring board is minimized by using not a pivot manner but a sliding manner and thus damage of the ink-cartridge loaded on a device can be minimized and an accuracy and reliability of test result in the case of testing can be maximized.

Technical Solution

The ink-cartridge loading/unloading apparatus according to the present invention comprises a vertically extending main body provided with a plurality of contacts of a signal transferring circuit arranged in a front surface thereof and contacting with contacts of a flexible printed wiring board, of an ink-cartridge, and a support portion formed in vertical direction on a front surface thereof and contacting with side surfaces or an upper surface of the ink-cartridge to support them thereby preventing the ink-cartridge from freely moving; a mounting part horizontally extending so as to be connected to the front surface of the main body and formed with a receiving groove receiving the ink-cartridge to support it thereby preventing the ink-cartridge from freely moving; and a coupling part connecting the main body and the mounting part, having flexible material or shape and provided with a locking member for maintaining coupled state after coupling of the main body and the mounting part.

In the ink-cartridge loading/unloading apparatus according to the present invention, a metal coupling bar is attached to a magnetic substance inserted in the locking member by magnetic force of the magnetic substance, whereby the mounting part is coupled to the main body, and in a further embodiment a metal coupling bar or a magnetic substance inserted in a front tip of a coupling bar is attached to an electromagnet provided in a side of the main body by a magnetic force of the electromagnet, whereby the mounting part is coupled to the main body.

In addition, referring to a releasing and coupling method between the mounting part and the main body, the mounting part is released from a state of being coupled to the main body, as the magnetic substance is moved down and thus the magnetic force is decreased, by pressing a button bar of the locking member with an external force, and a elastic means is further provided between the mounting part and the main body so that when the coupled state between the mounting part and the main body is released they are restored to a state before coupling.

DESCRIPTION OF DRAWINGS

The above and other objects, features and advantages of the present invention will become apparent from the following description of preferred embodiments given in conjunction with the accompanying drawings, in which:

FIG. 1 is a perspective view of a conventional ink-cartridge loading/unloading apparatus;

FIG. 2 is a perspective view of an ink-cartridge loading/unloading apparatus according to the present invention;

FIG. 3 shows a state of using the ink-cartridge loading/unloading apparatus according to the present invention;

FIG. 4 and FIG. 5 show a first embodiment of a coupling means for coupling a mounting part and a main body;

FIG. 6 and FIG. 7 show a second embodiment of the coupling means for coupling a mounting part and a main body;

FIG. 8 and FIG. 9 show a third embodiment of the coupling means for coupling the mounting part and the main body;

FIG. 10 and FIG. 11 show a forth embodiment of the coupling means for coupling the mounting part and the main body; and FIG. 12 and FIG. 13 show a fifth embodiment of the coupling means for coupling the mounting part and the main body.

DETAILED DESCRIPTION OF MAIN ELEMENTS

100: loading/unloading apparatus according to the present invention
110: main body
111: signal transferring circuit
111*a*: contact
112*a*: upper support portion
112*b*: side support portion
120: mounting part
121: receiving groove
130: coupling part
131: coupling bar
131*a*: engaging portion
132A, 132B, 132C, 132D, 132E: locking member
132A1: button bar
132A2: through hole
132A3: locking member spring
132A4: engaging protrusion
132B1: magnetic substance
132B2: coupling passage
132C1: button bar
132C2: magnetic substance
132C3: non-magnetic substance
132C4: elastic body
132D1: magnetic substance
132D2: electric source
132D3: coupling passage
132D4: switch
132D5: switch button
132E1: magnetic substance
132E2: electric source
132E3: coupling passage
132E4: ON switch
132E5: ON switch button
132E6: OFF switch
132E7: OFF switch button
133: spring
133*a*: spring shaft
200: conventional loading/unloading apparatus
210: main body
220: holder
230: locking member
300: ink-cartridge
301: flexible printed wiring board
301*a*: contact

BEST MODE

Hereinafter, the embodiments of the present invention will be described in detail with reference to accompanying drawings.

FIG. 1 is a perspective view of an example of a conventional ink-cartridge loading/unloading apparatus (a tester is shown in FIG. 1). As shown, an ink-cartridge 300 is received in a holder 220, which is provided at a lower portion of a main body 210 of the ink-cartridge loading/unloading apparatus, and then pivoted by a predetermined angle. Thereafter, the ink-cartridge 300 is locked by a locking member 230 which is provided at an upper portion of a main body 210, in which a minute gap is formed between a contact of a flexible printed wiring board of the ink-cartridge 300 and a contact of a signal transferring circuit of a device before the ink-cartridge 300 is locked by the locking member 230 but, in the process of locking the ink-cartridge 300 by the locking member 230, the ink-cartridge 300 is further pivoted by a minute angle, whereby the contact of the flexible printed wiring board and the contact of the signal transferring circuit come into contact completely and connected with each other.

At this time, in order that a surface on which the contact of the flexible printed wiring board is arranged and a surface on which the contact of the signal transferring circuit is arranged come into contact entirely and completely, it is desirable that both surfaces are not only in contact with each other but also subjected to a little more pressure. That is, it should be designed that both surfaces are in a position slightly closer to each other than an exact position where the both surfaces come into contact on the basis of an original geometrical shape. However, as the ink-cartridge 300 is designed to pivot with respect to the main body 210, in the above mentioned case, both surfaces, where the ink-cartridge 300 and the loading/unloading apparatus 200 of the device are in contact with each other, are not parallel with each other but angled at a minute angle and thus it is possible that the ink-cartridge 300 is subjected to a pressure which is distributed not uniformly over entire surfaces but always to be leaned to one side. Moreover, as, in the process of contact by pivot, each surface begins to be subjected to a pressure from one side thereof, there is a problem that they are always subjected to a biased pressure when loading the ink-cartridge 300. Such pressure biased to one side is largely responsible for a deformation of shape or a scar in a position which is subjected to more pressure. Moreover, the ink-cartridge 300 is continuously subjected to biased pressure by the above process due to the characteristics of the device, thereby resulting in decrease in lifetime of the ink-cartridge 300.

Furthermore, as mentioned above, because both surfaces come into contact while being subjected to the biased pressure, it is possible that malfunction of the device (poor printing quality in the case of a printer, error in measurement of remained amount of ink to be supplied, error in good/bad decision to an ink-cartridge and etc.) is occurred, as contacts of the flexible printed wiring board of the ink-cartridge 300 and contacts of the signal transferring circuit of the device can not come into contact in correct places from beginning or they come into contact in correct places at beginning but the contact positions are gradually displaced.

FIG. 2 is a perspective view of an ink-cartridge loading/unloading apparatus according to the present invention which is presented to solve the above mentioned problems and FIG. 3 shows by stages a state that an ink-cartridge is loaded onto the ink-cartridge loading/unloading apparatus according to the present invention. The ink-cartridge loading/unloading apparatus according to the present invention will be described in detail with reference to FIG. 2.

As shown in FIG. 2, the ink-cartridge loading/unloading apparatus 100 according to the present invention is largely provided with a main body 110, a mounting part 120 and a coupling part 130.

The main body 110 is a part which is attached and connected to various devices onto which an ink-cartridge is loaded/unloaded, and through contacts 111*a* of a signal transferring circuit 111 which is exposed on a front surface of the main body 110 signal is transferred. On the front surface of the main body 110 are projected side support portions 112*b* and an upper support portion 112*a* so as to contact with an ink-cartridge 300 to support it. By the side support portions 112*b* and the upper support portion 112*a*, up/down and left/right motion of the ink-cartridge 300 is prevented when the ink-cartridge 300 is loaded on the present apparatus. Standard and shape of the side support portions 112*b* and the upper support portion 112*a* are determined in accordance with the ink-cartridge 300. It is desirable that the side support portions 112*b* are formed with minute gaps between the left/right side surfaces of the ink-cartridge 300 and thus the ink-cartridge 300 can be smoothly inserted into or ejected from the side support portions 112*b*. Further, the upper support portion 112*a* also may be formed such that the ink-cartridge 300 can be smoothly inserted into or ejected from the upper support portion 112*a* likewise the side support portions 112*b*, otherwise, as a different variation, it is desirable that the upper support portion 112*a* is formed with an engaging part so as to be firmly engaged with a fixing groove formed on a cap or upper surface of the ink-cartridge 300 and thus an external force for firmly locking the ink-cartridge 300 and pressing the ink-cartridge 300 to the main body 110 can be generated.

The mounting part 120, as shown, is provided with U-shaped receiving groove 121 of which a bottom surface is blocked, and has a function that supports a left side surface, a right side surface, a bottom surface and a front surface by such shape thereof and thus prevents left/right and up/down motion of the ink-cartridge 300 and make it possible of stable connection together with the side support portions 112*b* and the upper support portion 112*a*.

A main subject matter of the present invention is the coupling part 130 which connects the main body 110 and the mounting part 120. The functions of the main body 110 and the mounting part 120 are not greatly different to that of corresponding portions of the conventional ink-cartridge loading/unloading apparatus. However, a main body and a coupling part are connected to pivot in prior art as explained in description of FIG. 1 but it is different in that the main body 110 and the coupling part 120 are connected so as to be capable of sliding.

It is a significance of the present invention that as the ink-cartridge 300 is inserted into the loading/unloading apparatus 100 as such, problems generated by biased distribution of pressure in conventional pivot manner (for example, shape deformation of or generation of scar in ink-cartridge contacts and device contacts and resulting decrease in lifetime or generation of incorrect testing result due to incorrect contact or etc.) can be solved at the same time.

The coupling part 130 is desirably further provided with a locking member 132 and a spring 133. If the locking member 132 is provided, the coupling part 130 is fixed by the locking member 132 so as not to be moved and thus the ink-cartridge 300 fixed by the upper support portion 112*a* of the main body 110 can be more firmly fixed. Though a user may separate the main body 110 and the coupling part 130 manually without the spring 133, if the spring 133 is provided as shown, there is an effect that the spring 133 is pressed and locked by the locking member 132 when the coupling part 120 comes into contact with the main body 110 and the coupling part 120 is pushed out by a repulsive force of the spring 133 when the locking member 132 is released, whereby a user can easily remove the ink-cartridge 300 which ink filling is completed from the loading/unloading apparatus 100. It is desirable to be further provided with a spring shaft 133*a* when the spring 133 is provided, thereby preventing the spring 133 from freely moving in left/right directions and allowing the spring 133 to move only in longitudinal direction along which the spring is extended and contracted.

As shown in FIG. 3, in the loading/unloading apparatus 100 according to the present invention, the ink-cartridge 300 is received in the coupling part 120 (A), the coupling part 120 is slid and fixed by the locking member 132 and thus the contacts 302 of the flexible printed wiring board 301 of the ink-cartridge 300 come into contact with and are connected to the contacts 111*a* of the signal transferring circuit 111 at the front surface of the main body 110 (B). In FIG. 3, the above process is illustrated by steps A and B.

Referring to FIG. 4 to FIG. 8, various embodiments of the present invention will be described. As above mentioned, a different point of the ink-cartridge loading/unloading apparatus according to the present invention from the conventional loading/unloading apparatus is essentially in the coupling part 130, therefore description will be concentrated on it.

FIG. 4 and FIG. 5 show the first embodiment of the shape of the coupling part 130 in detail. In this case, the coupling part 130 may not be provided with the spring 133 (FIG. 4), but it is desirable to be provided with the spring 133 (FIG. 5).

A step A in FIG. 4 shows a state which is before coupling, a tip of a coupling bar 131 is formed with a engaging portion 131*a* as shown and at a body of a button bar 132A1 of the locking member 132 is formed a through hole 132A2 of which size is such that the engaging portion 131*a* of the coupling bar 131 is able to pass through. The coupling bar 131 is pushed into the through hole 132A2 as shown in step B by moving the coupling part 120 toward the main body 110 for loading the ink-cartridge. The engaging portion 131*a* of the coupling bar 131 is smoothly pushed through the through hole 132A2 toward the main body 110 as it has a smooth curvature at a surface of proceeding side thereof, the button bar 132A1 of the locking member 132 is pushed down as the engaging portion 131*a* of the coupling bar 131 is pushed in and the spring 132A3 of the locking member 132 is pressed toward compression direction by the engaging protrusion 132A4 and thus comes into the state of being compressed. As shown in step C, the engaging portion 131*a* passes completely through the through hole 132A2 of the button bar 132A1, then the button bar 132A1 moves back to the original position by a force of restoration of the spring 132A3 of the locking member and thus the coupling bar 131 is engaged with the through hole 132A2 by the engaging portion 131*a* so as to be in a coupled state of not moving. It is necessary to press again the locking member 132 for releasing the coupled state, specifically the button bar 132A1 is pushed down by pressing the locking member 132 then a position of the through hole 132A2 is lowered so that the engaging portion 131*a* of the coupling bar 131 can pass through, whereby the engaging portion 131*a* can get out of the through hole 132A2.

As shown in FIG. 5, in the case that the coupling part 130 is further provided with the spring 133, the spring 133 of the coupling part 130 is in a contracted state in the coupled state (steps B and C). The coupled state is released by pressing the locking member 132 and then the mounting part 120 comes back to the original position by a force of restoration of the spring 133 of the coupling part 130 which is contracted in step C at the same time that the coupling bar 131 get out of the through hole 132A2. Though the force of restoration is generated by contraction of the spring 133 in the coupled state, in a variation the force of restoration may be generated by extension of the spring 133.

FIG. 6 and FIG. 7 show in detail the second embodiment of the shape of the coupling part 130. In this case, the coupling part 130 may not be provided with the spring 133 (FIG. 6), but it is desirable to be provided with the spring 133 (FIG. 7). In a locking member 132B of the present embodiment shown in FIG. 6 and FIG. 7, a coupling passage 132B2 into which the coupling bar 131 is inserted is bored and a magnetic substance is provided therein, therefore there is an advantage that the coupling part 120 can be sufficiently coupled to the main body while the manufacturing can be easily carried out and the manufacturing cost is very inexpensive as the shape is very simple.

Step A in FIG. 6 shows a state before coupling the main body 110 and the coupling part 120 and step B shows a coupled state, a user moves manually the coupling bar 120 to a position in which an attraction force of the magnetic substance 132B1 can attract the coupling bar 131 and then the magnetic substance 132B1 and the coupling bar 131 come into contact with each other by the magnetic attraction force, whereby the main body 110 and the coupling part 120 are coupled. On the contrary, in order to release the coupled state, a user pulls manually the coupling part 120 to apply a mechanical force overcoming the attraction force of the magnetic substance 132B1 thereby separating the main body 110 and the mounting part 120 over a predetermined distance, then the attraction force of the magnetic substance 132B1 is no longer capable of attracting the coupling bar 131 and the coupling part 120 maintains the separated position.

As shown in FIG. 7, in the case that the coupling part 130 is further provided with the spring 133, the attraction force of the magnetic substance 132B1 should be as strong as it overcomes the force of restoration of the spring 133. Other operations except the above operation are as same as the first embodiment and thus will not be described herein.

Further, in order for the coupling bar 131 to be attracted by the magnetic substance 132B1, the coupling bar 131 may be made of metal or may be provided with a magnetic substance (not shown) on a surface of the coupling bar 131, the surface thereof being in contact with the magnetic substance 132B1.

FIG. 8 and FIG. 9 show in detail the third embodiment of the shape of the coupling part 130. In this case, the coupling part 130 may not be provided with the spring 133 (FIG. 8), but it is desirable to be provided with the spring 133 (FIG. 9). It is used a fixing manner using a magnetic force likewise the second embodiment and a button for convenient separation is further provided.

Step A in FIG. 8 shows a state before coupling the coupling bar 131 and a button bar 132C1 of a coupling member 132C. The coupling bar 131 is distant from the button bar 132C1 so that the coupling bar 131 does not attracted by a magnetic force of a magnetic substance 132C2 of the button bar 132C1 in their initial positions, but a user pushes the coupling bar 131 toward the main body 110, specifically the magnetic substance 132C2 and then the coupling bar 131 is subjected to attraction force toward the magnetic substance 132C2 of the button bar 132C1 as shown in step A in FIG. 8 by a magnetic force of the magnetic substance 132C2. Consequently, coupled state is maintained by the magnetic attraction force between the coupling bar 131 and the magnetic substance 132C2 as shown in step B in FIG. 8. Releasing the coupled state can be achieved by pushing down the button bar 132C1 of the coupling member 132C as shown in step C in FIG. 8 and by the aforementioned operation non-magnetic portion 132C3 of the button bar 132C1 and the coupling bar 131 come into contact and thus a user can easily separates the coupling part 120 even by manual as the magnetic attraction force between the coupling bar 131 and the button bar 132C1 which maintains the coupled state is eliminated. Further, it is desirable that by providing an elastic body 132C4 at a lower end of the button bar 132C1, the button bar 132C1 comes back to the original position by the force of restoration of the elastic body 132C4 after the coupled state is completely released.

FIG. 9 is a schematic diagram illustrating the case that a spring 133 is further provided to the coupling part 130 as well as the locking member 132C. A principal of coupling or releasing the coupling bar 131 and the locking member 132C of the button bar 132C1 is as same as above mentioned, however in this case it is necessary to design the coupling part 130 under a condition that the magnetic attraction force should have a larger value than that the force of restoration of the spring 133 so as to maintain the coupled state. As shown in FIG. 9, in the case that the spring 133 is further provided to the coupling part 130, if the magnetic attraction force between the coupling bar 130 and the button bar 132C1 is eliminated by pushing down the locking member 132C, the coupling bar 131 comes back to the original position by the force of restoration of the spring 133 and thus the mounting part 120 is automatically separated, whereby user convenience can be further improved. Meanwhile, though it is not shown, it may be configured such that material of the mounting part 120 or coupling bar 131 is made of plastic and a magnetic substance (not shown) is inserted into a front tip of the coupling bar 131 so as to be attached to the magnetic substance 132C2 inserted into the locking member by magnetic force.

FIG. 10 and FIG. 11 show in detail the forth embodiment of the shape of the coupling part 130. In this case, the coupling part 130 may not be provided with the spring 133 (FIG. 10), but it is desirable to be provided with the spring 133 (FIG. 11). It is used a fixing manner using a magnetic force likewise the second and the third embodiments but it is different from the above embodiments that an electromagnet is used instead of a permanent magnet, and a switch and a button for operating the electromagnet are provided. Also, whether an ink-cartridge is loaded on the mounting part 120 or not has no relation to coupling state and condition of the coupling part 130 in above three embodiments, however in this embodiment it is different from the above embodiments that the mounting part 120 does not coupled to the main body 110 if an ink-cartridge is not loaded on the mounting part 120.

As shown in FIG. 10, in an initial stage, magnetic force is not generated from an electromagnet 132D1 as a switch 132D4 of a locking member 132D is opened. As shown in step A, the mounting part 120 and a coupling bar 131 are moved toward a main body after loading an ink-cartridge 300 on the mounting part 120, then the switch button 132D5 provided at an center of the main body 110 is pushed by a front surface of the ink-cartridge 300 thereby the switch 132D4 being closed and thus the electromagnet 132D1 is operated to have magnetic force. Then, as shown in step B, the coupling bar 131 and the electromagnet 132D1 are firmly coupled by the magnetic force and the coupled state between the main body 110 and the mounting part 120 is maintained. Unloading of the ink-cartridge 300 can be carried out by a user moving manually the mounting part on which the ink-cartridge is received away from the main body 110. Specifically, a user applies mechanical external force, which is any stronger than the magnetic force generated from the electromagnet 132D1, so as to separate the main body 110 and the mounting part 120 in any distance, and then the switch 132D4 is opened as the initial step A by the switch button 132D5 coming back to the original position as the ink-cartridge is moved back and thus an electric source applied to the electromagnet 132D1 is cut off and the coupled state is not maintained any longer. Though it is not shown in the present drawing, it is desirable that the switch button 132D5 includes a mechanical structure such as an elastic body, an engaging portion and etc. (refer to the spring 132A3 and the engaging protrusion 132A4 in FIG. 4 and FIG. 5) so that it comes back to the original position when pushing force of an ink-cartridge is eliminated. Further, an electric source applied to the locking member 132D may be supplied by a device (a device on which an ink-cartridge is loaded such as a printer, a refilling device, a tester and etc.) or a separate battery.

FIG. 11 is a schematic diagram showing a case that the coupling part 130 is provided further spring 133 as well as the locking member 132D using an electromagnet. Coupling or releasing principal is as same as above mentioned, the mounting part 120 and the ink-cartridge 300 received therein come back automatically to the original position as the force of restoration is applied by further spring 133 of the coupling part when unloading the ink-cartridge 300, whereby user convenience can be further improved.

FIG. 12 and FIG. 13 show in detail the fifth embodiment of the shape of the coupling part 130. In this case, the coupling part 130 may not be provided with the spring 133 (FIG. 12), but it is desirable to be provided with the spring 133 (FIG. 13). The fifth embodiment is an enhanced variation of the forth embodiment, and this embodiment further provided with an OFF switch unlike the forth embodiment in which a user moves back manually the mounting part 120 to unload it.

As shown in FIG. 12, the present embodiment is very similar to the forth embodiment shown in FIG. 10 but further provided with an OFF switch 132E6 and an OFF switch button 132E7, and the switch 132D4 and switch button 132D5 in the forth embodiment and an ON switch 132E4 and an ON switch button 132E5 perform the same function. Therefore, steps A and B are not described herein as the steps are as same as the forth embodiment and operation of unloading will be described with reference to the step C. As shown, the OFF switch 132E6 is initially in closed state and maintains the closed state even in coupled state. In the case that a user want to unload, the OFF switch 132E6 is opened as the OFF switch button 132E7 is moved down by pushing down the OFF switch button 132E7 and by opening of the OFF switch 132E6 an electric source is cut off although in spite that the ON switch 132E4 is still closed, whereby magnetic force from the electromagnet 132E1 is not generated. Therefore, the user can easily separate the ink-cartridge 300 and the mounting part 120. Likewise the forth embodiment, though it is not shown, it is desirable that the ON switch button 132E5 and OFF switch button 132E7 are formed with an elastic body, an engaging portion so that the button come back to the original position when external force pushing the button is eliminated.

FIG. 13 is a schematic diagram showing a case that the coupling part 130 is provided further spring 133 as well as the locking member 132E using an electromagnet. Coupling or releasing principal is as same as above mentioned, the mounting part 120 and the ink-cartridge 300 received therein come back automatically to the original position as the force of restoration is applied by further spring 133 of the coupling part when unloading the ink-cartridge 300, whereby user convenience can be further improved.

The foregoing embodiments are merely exemplary and are not to be construed as limiting the present invention. The present teaching can be readily applied to other types of embodiments. Also, the description of the embodiments of the present invention is intended to be illustrative, and not to limit the scope of the claims, and many alternatives, modifications, and variations will be apparent to those skilled in the art.

INDUSTRIAL APPLICABILITY

According to the present invention, because uniformly distributed pressure is applied in a process that contacts of a flexible printed wiring board of an ink-cartridge and contacts of a signal transferring circuit of a device come into contact with each other by sliding when loading the an ink-cartridge onto the device, problems that contacts of the ink-cartridge and contacts of the device are in contact with each other in incorrect positions thereby generating incorrect testing result or the ink-cartridge is permanently incapable of using by generation of shape deformation or a scar can be solved at the same time, and thus there are advantages that recycling rate and lifetime of the ink-cartridge are increased and accuracy and reliability in testing result of the ink-cartridge are increased as well.

The invention claimed is:

1. An ink-cartridge loading/unloading apparatus comprising:

a vertically extending main body provided with a plurality of contacts of a signal transferring circuit arranged in a front surface thereof and contacting with contacts of a flexible printed wiring board of an ink-cartridge, and a support portion formed in vertical direction on a front surface thereof and contacting with side surfaces or an upper surface of the ink-cartridge to support them thereby preventing the ink-cartridge from freely moving;

a mounting part horizontally extending so as to be connected to the front surface of the main body and formed with a receiving groove receiving the ink-cartridge to support the ink-cartridge thereby preventing the ink-cartridge from freely moving; and a coupling part for connecting the main body and the mounting part, wherein the support portion is further formed with an engaging portion so that the ink-cartridge is securely supported using a shape thereof, wherein the ink-cartridge is inserted into the receiving groove vertically and the mounting part receiving the ink-cartridge slides to the main body horizontally.

2. An ink-cartridge loading/unloading apparatus comprising:

a vertically extending main body provided with a plurality of contacts of a signal transferring circuit arranged in a front surface thereof and contacting with contacts of a flexible printed wiring board of an ink-cartridge, and a support portion formed in vertical direction on a front surface thereof and contacting with side surfaces or an upper surface of the ink-cartridge to support them thereby preventing the ink-cartridge from freely moving;

a mounting part horizontally extending so as to be connected to the front surface of the main body and formed with a receiving groove receiving the ink-cartridge to support it thereby preventing the ink-cartridge from freely moving; and a coupling part for connecting the main body and the mounting part, wherein the support portion is further formed with an engaging portion so that the ink-cartridge is securely supported using a shape thereof, wherein the mounting part is coupled to the main body by inserting a coupling bar formed with an engaging portion into a through hole of a locking member of the coupling part so that the engaging portion is engaged with the through hole.

3. The ink-cartridge loading/unloading apparatus as set forth in claim 2, wherein a coupled state between the mounting part and the main body is released by pressing a button bar of the locking member with an external force.

4. The ink-cartridge loading/unloading apparatus as set forth in claim 3, wherein an elastic means is further provided between the mounting part and the main body so that when the coupled state between the mounting part and the main body is released they are restored to a state before coupling.

5. An ink-cartridge loading/unloading apparatus comprising:

a vertically extending main body provided with a plurality of contacts of a signal transferring circuit arranged in a front surface thereof and contacting with contacts of a flexible printed wiring board of an ink-cartridge, and a support portion formed in vertical direction on a front surface thereof and contacting with side surfaces or an upper surface of the ink-cartridge to support them thereby preventing the ink-cartridge from freely moving;

a mounting part horizontally extending so as to be connected to the front surface of the main body and formed with a receiving groove receiving the ink-cartridge to support it thereby preventing the ink-cartridge from freely moving; and a coupling part for connecting the main body and the mounting part, wherein the support portion is further formed with an engaging portion so that the ink-cartridge is securely supported using a shape thereof, wherein a metal coupling bar or a coupling bar having a metal attached to a front tip thereof is attached to a magnetic substance provided in a locking member of the coupling part by magnetic force of the magnetic substance, whereby the mounting part is coupled to the main body.

6. The ink-cartridge loading/unloading apparatus as set forth in claim 5, wherein the mounting part is released from a state of being coupled to the main body, as the magnetic substance is moved down and thus the magnetic force is decreased, by pressing a button bar of the locking member with an external force.

7. The ink-cartridge loading/unloading apparatus as set forth in claim 6, wherein an elastic means is further provided between the mounting part and the main body so that when the coupled state between the mounting part and the main body is released they are restored to a state before coupling.

8. An ink-cartridge loading/unloading apparatus comprising:

a vertically extending main body provided with a plurality of contacts of a signal transferring circuit arranged in a front surface thereof and contacting with contacts of a flexible printed wiring board of an ink-cartridge, and a support portion formed in vertical direction on a front surface thereof and contacting with side surfaces or an upper surface of the ink-cartridge to support them thereby preventing the ink-cartridge from freely moving;

a mounting part horizontally extending so as to be connected to the front surface of the main body and formed with a receiving groove receiving the ink-cartridge to support it thereby preventing the ink-cartridge from freely moving; and a coupling part for connecting the main body and the mounting part, wherein the support portion is further formed with an engaging portion so that the ink-cartridge is securely supported using a shape thereof, wherein a metal coupling bar or a magnetic substance inserted in a front tip of a coupling bar is attached to an electromagnet provided in a side of the main body by a magnetic force of the electromagnet, whereby the mounting part is coupled to the main body.

9. The ink-cartridge loading/unloading apparatus as set forth in claim 8, wherein as the ink-cartridge received in the mounting part moves towards the main body, a switch which applies an electric source to the electromagnet is pressed thereby operating the electromagnet.

10. The ink-cartridge loading/unloading apparatus as set forth in claim 9, wherein an elastic means further provided between the mounting part and the main body so that when the coupled state between the mounting part and the main body is released they are restored to a state before coupling.

11. The ink-cartridge loading/unloading apparatus as set forth in claim 9, wherein a switch which cuts the electric source off the electromagnet is provided additionally in the main body or the coupling part.

12. The ink-cartridge loading/unloading apparatus as set forth in claim 11, wherein an elastic means is further provided between the mounting part and the main body so that when the coupled state between the mounting part and the main body is released they are restored to a state before coupling.

* * * * *